US006960102B2

(12) United States Patent
Styles

(10) Patent No.: US 6,960,102 B2
(45) Date of Patent: Nov. 1, 2005

(54) UNIVERSAL TEST CONNECTOR AND METHOD OF ASSEMBLY

(75) Inventor: Robert Styles, Granger, IN (US)

(73) Assignee: Honeywell International, Inc., Morristown, NJ (US)

( * ) Notice: Subject to any disclaimer, the term of this patent is extended or adjusted under 35 U.S.C. 154(b) by 78 days.

(21) Appl. No.: 10/305,763

(22) Filed: Nov. 27, 2002

(65) Prior Publication Data

US 2004/0102090 A1 May 27, 2004

(51) Int. Cl.[7] ..... H01R 13/50
(52) U.S. Cl. ..... 439/604; 439/276
(58) Field of Search ..... 439/276, 604, 439/606, 695, 730, 932, 158

(56) References Cited

U.S. PATENT DOCUMENTS 2,959,766 A 11/1960 Jacobsen
3,271,727 A * 9/1966 Nelson ..... 439/281
3,539,973 A 11/1970 Antes et al.
3,747,048 A 7/1973 Johnson et al.
3,816,641 A * 6/1974 Iversen ..... 174/76
3,842,496 A 10/1974 Mercer
4,057,310 A 11/1977 Young
4,335,932 A * 6/1982 Herrmann, Jr. ..... 439/587
4,382,653 A * 5/1983 Blanchard ..... 439/610
4,911,652 A * 3/1990 Savoca et al. ..... 439/282
4,959,792 A 9/1990 Sullivan
5,595,497 A * 1/1997 Wood ..... 439/282
5,831,217 A 11/1998 Jarvis et al.
6,123,549 A 9/2000 Williams
6,272,387 B1 8/2001 Yoon
6,314,481 B1 11/2001 Fehlhaber
6,358,095 B1 3/2002 Rootz et al.
6,423,952 B1 * 7/2002 Meisiek ..... 219/544

* cited by examiner

*Primary Examiner*—Phuong Dinh
(74) *Attorney, Agent, or Firm*—Ingrassia Fisher & Lorenz

(57) ABSTRACT

A method of assembling an electrical test connector for testing connectivity in aircraft wire harness fitted with military specification or other electrical connectors. In a particular embodiment, the test connector is manually assembled on site by a technician from components that are readily and inexpensively available, providing ease and speed in completing connectivity or other wire testing. The test connector has a mating insert, selected and configured to mate with an identified aircraft connector present on the harness to be tested. Insulation and internal wire support is provided by packing the wire connections with a potting material and covering the test connector with an optional heat shrink tubing. Alignment to the aircraft connector may be keyed with the use of a visual indicator applied to the covering. The components as a kit and the assembled test connector are also provided.

29 Claims, 8 Drawing Sheets

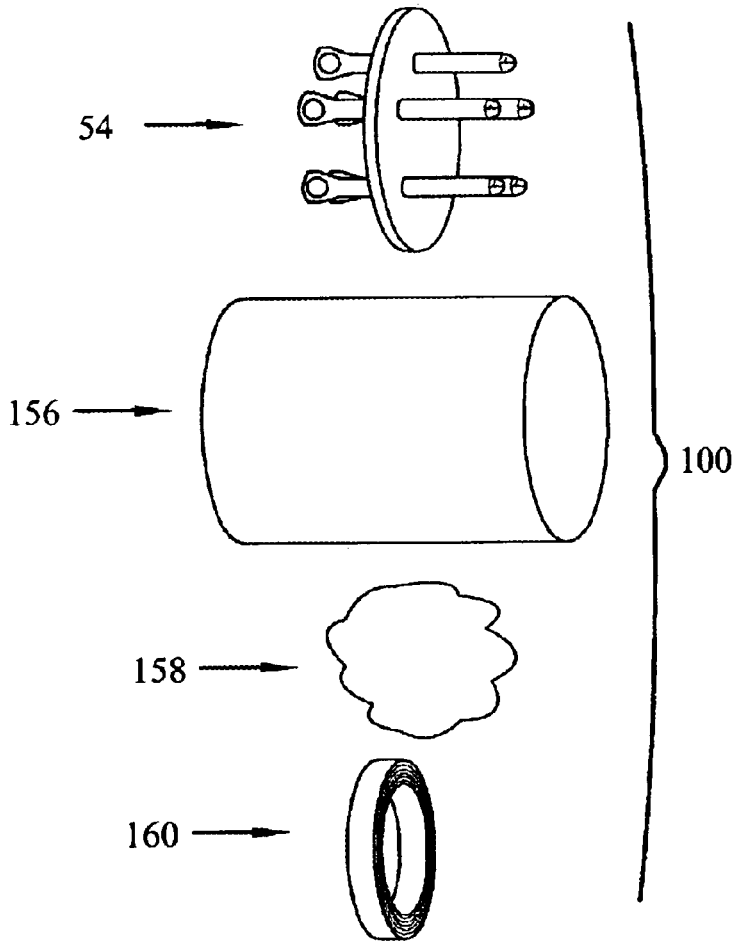
FIG. 2
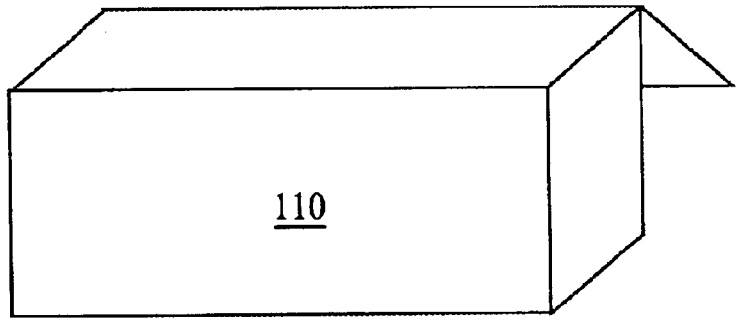

UNIVERSAL TEST CONNECTOR AND METHOD OF ASSEMBLY

FIELD OF THE INVENTION

This invention relates in general to electrical connectors, and in particular, to test-purpose electrical connectors for mating to electrical connectors used in aircraft wire harnesses, and more particularly to a method of assembling aircraft wire harness cylindrical test connectors manually on the test site.

BACKGROUND OF THE INVENTION

Many modern civilian and military aircraft are dependent upon electrical systems for proper operation. Often, miles of wires interconnect the electrical systems within an aircraft. During the life of the aircraft, these wires are subject to vibration, corrosion, aging, and other stresses.

Failure of a wire or set of wires in an aircraft wire harness may result in a spectrum of events ranging from the malfunction of a simple light bulb to the malfunction of an aircraft system. As an aircraft ages, wire related maintenance costs and related interruptions in service of the aircraft for wire repair can be costly and can occur with increasing frequency.

In general, it is not practical to remove an aircraft wire harness from an aircraft for inspection. As well as being costly and time consuming, re-installing a wire harness after a successful test may stress and strain the wire harness and induce other unknown wire faults. Therefore, to minimize aircraft downtime, cost and overall complexity, it is generally desirable to test an aircraft wire harness without removing it from the aircraft.

With the amount of wire generally contained in an aircraft, the presence of insulation generally covering the wires, and aircraft parts covering the insulated wires and wire harnesses, electrical connectivity testing may be selectively used in addition to selective visual inspections.

To facilitate connections between systems, some wire harnesses employ military specification electrical connectors. Military specification connectors are designed to withstand stress and/or to provide protection for the integrity of the electrical connection against many factors commonly including weather, moisture, altitude, pressure, vibration, temperature, etc. . . . all of which may cause connectivity failure during operation and/or permit deterioration and/or corrosion of the connection contacts.

To provide a robust and functional connection, a military specification electrical connector generally is manufactured to certain standards that provide: A) protection of the electrical connection; B) proper alignment of the connection; and C) a firm engagement by the connector beyond a mere friction hold.

The connectivity an aircraft wire harness may be tested by attaching test equipment with corresponding mating military specification connectors (See FIG. 1A.) to the wire harness. In this manner, a connector on the test equipment wire harness may be mated to a connector on the aircraft harness to be tested. The process of connecting a military specification connector to a test equipment wire harness may be a complex process that may involve specialized tooling, training, and time consuming assembly processes.

FIG. 1 A shows one prior art military specification electrical aircraft connector 7 for aircraft wire harnesses. The military connector has a hard metal backshell 9, a metal shield 15, a slot 17 and a lock mechanism 19. The metal backshell 9 protects the harness wires 11 at their point of connection to the roots (not shown) of the connector's pins or sockets 13, and provides a grasping point. The metal shield 15 protects the contact pins or sockets 13. The slot 17 is a physical alignment device that permits the connector 7 to be joined to a mating connector in an aligned orientation. The connection lock mechanism, such as a threaded coupling 19 serves to securely engage one military specification connector to a mating military specification connector in a specific robust alignment. As shown, the backshell 9 of military specification electrical connector 7 can incorporate a compression clamp 21 for securing the backshell 9, and thus the connector 7, to the wire harness 11.

Specialized tooling and manufacturing processes are used to make a military specification electrical connector. Such rigorous tooling and manufacturing requirements are reflected in the costs of military specification connectors, with per connector costs ranging from several hundred to thousands of dollars.

Fabricating a test harness with military specification connectors can become an arduous and expensive task because the wire harness for a typical auxiliary power supply may have as many as a dozen military specification electrical connectors. In addition, the number of military specification electrical connectors within a given aircraft may number in the hundreds if not in the thousands. Further, different aircraft and different versions of aircraft generally have different military specification electrical connectors. With the wide variety of military specification electrical connectors in use, it is expensive to maintain an inventory of pre-assembled test purpose wire harnesses. In addition, the high cost of the military specification electrical connectors makes disposal of the entire test harness after use undesirable. It is therefore a practice to disassemble the test harness so the military specification connectors can be reused. This can be time consuming and expensive.

With high costs, bulky size, specialized attachment processes, and time consuming coupling and de-coupling to test wires, maintaining an inventory of military specification electrical connectors for use in testing aircraft wire harness can be wasteful of time and resources.

Hence, there is a need for a test-purpose connector, and a related method of assembly, for use with military specification electrical aircraft connectors, that overcomes one or more of the drawbacks identified above. The present invention satisfies one or more of these needs.

SUMMARY OF THE INVENTION

This invention provides an electrical test connector assembly and related method for mating to military specification or other electrical aircraft connectors for the purpose of quick and/or inexpensive testing of aircraft wire harnesses.

In particular, and by way of example only, one preferred embodiment of the assembly includes a method of manually assembling a test connector to attach a test wire harness to a connector of an aircraft wire harness. The method includes obtaining an insert configured to mate with the aircraft connector; joining at least one wire of the test wire harness to the insert; and packing each joined wire of the test harness with potting material in the area where connected to the insert.

In optional details, the method may include covering the potting material. The method may also include providing an alignment indicator, such as a marking, to key mating alignment of the test connector to the aircraft connector. Likewise the method may include the use of a military specification insert and the use of heat shrink tubing as the covering.

Moreover, according to a preferred embodiment thereof, the invention may provide a method of manually assembling a test connector to attach a test wire harness to a connector of an aircraft wire harness. The aircraft connector has an alignment key. The method includes obtaining an insert configured to mate with the aircraft connector; joining at least one wire of the test wire harness to the insert; packing each joined wire of the harness with non-conductive potting material in the area where the wires are connected to the insert; covering the potting material and joined wires with a non-conductive cover material; and providing an alignment indicator on the covering to key mating alignment of the test connector to the aircraft connector.

In another embodiment, the invention may provide a test connector assembly for use in connecting a test wire harness to a connector of an aircraft wire harness. The test connector includes a mating insert configured to mate with the aircraft connector. The insert has a first side and an opposed second side, and a plurality of electrical contacts. Each contact has one end configured to mate with an aircraft connector and another end joined to at least one of the test wires from the test wire harness. A non-conductive potting material is manually inserted between the joined test wires proximate to the insert and a flexible. Optionally, a non-conductive cover material may be manually installed around the potting material joined test wires, and an alignment indicator such as a marking may be provided.

Furthermore, this invention also provides, in accordance with a preferred embodiment thereof, a kit for assembling at least one test connector for use in connecting a test wire harness to at least one predetermined connector of an aircraft wire harness. The kit has at least one conductive mating connector insert configured to mate with the predetermined aircraft connector; and a non-conductive potting material to support the test wire harness wires when joined to the insert. An optional non-conductive cover material to cover the potting material and joined test wires, and an optional marker material to identify key mating alignment of the test connector to the aircraft connector may be included.

These and other features and advantages of the preferred method and apparatus will become apparent from the following detailed description taken in conjunction with the accompanying drawings which illustrate, by way of example the principles of the invention.

BRIEF DESCRIPTION OF THE DRAWINGS

FIG. 2 depicts an exploded view of a kit and packaging for a kit that may be used to provide the components of the test connector of FIG. 7;

DETAILED DESCRIPTION

Figure 1A:
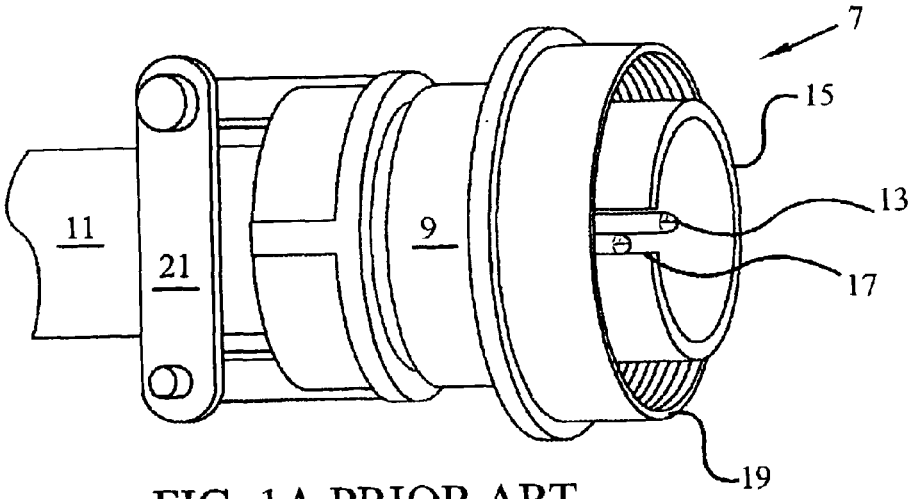
FIG. 1A PRIOR ART
FIG. 1A is a perspective view of an exemplary prior art military specification electrical connector.

Before proceeding with the detailed description, it is to be appreciated that the present invention is not limited to use or application with a specific type of military specification electrical connector. Thus, although the present invention is, for the convenience of explanation, depicted and described with respect to one type of a military specification electrical connector that may be found on an aircraft wire harness, this invention may be applied to other types and styles of electrical connectors incorporating pins, sockets, combinations of both, or other types of connections.

The invention is embodied in a test connector 200 (See FIGS. 6, 7 and 8) and a related method of assembling the test connector 200 at the testing site by a technician. The test connector 200 can be configured to connect to military specification or other electrical connectors on an aircraft wire harness to be tested.

The testing processes used to test aircraft wire harnesses are generally of short duration. The testing equipment need not utilize electrical connectors constructed to a military specification. More specifically, of three functions generally provided by a military specification electrical connector (protection, alignment, and firmness of connection beyond a mere friction hold), only alignment is generally required in a connectivity testing environment because the alignment most closely relates to a successful electrical connection between the mated connectors. The level of protection and firm connection that may be offered by military specification connectors generally are not needed in an aircraft wire harness testing environment and the use of such connectors can be time consuming and/or add expense to the testing process. Indeed, in some instances, the process of coupling all of the test wire connectors to the aircraft harness connectors via two interlocking military specification connectors to perform a test may take longer then the test process itself A preferred embodiment of the present invention is provided in FIG. 2, which shows an exploded view of a kit 100 and packaging 110 for a kit that may be used by a technician to quickly, easily and inexpensively assemble a test connector 200 (see FIG. 6). The kit of the present invention has at least one insert 54, at least one piece of optional cover material 156, potting material 158, and optional marker material 160. The cover material 156 is preferably non-conductive and flexible. In a preferred embodiment, and without limitation, the cover material 156 may be heat shrink tubing. The marker material 160 may also include paint or tape. The potting material 158, serving to pot, as in support and/or protect, the test wires to be connected to the insert 54, is preferably epoxy, silicone, rubber, acrylic, polyurethane or other non-conductive soft material or polymer. The test connector 200 as assembled from these components is advantageously preferred in the testing environment as compared to conducting the testing with a connector having the hardened backshell 9 and coupling 19 of the prior art military specification connector 7.

The kit 100 may also include other appropriate components and/or tools necessary to fabricate a test connector 200. Preferably, the included insert 54 is a military specification insert for mating to a military specification electrical connector on the aircraft wire harness to be tested.

Figure 5:
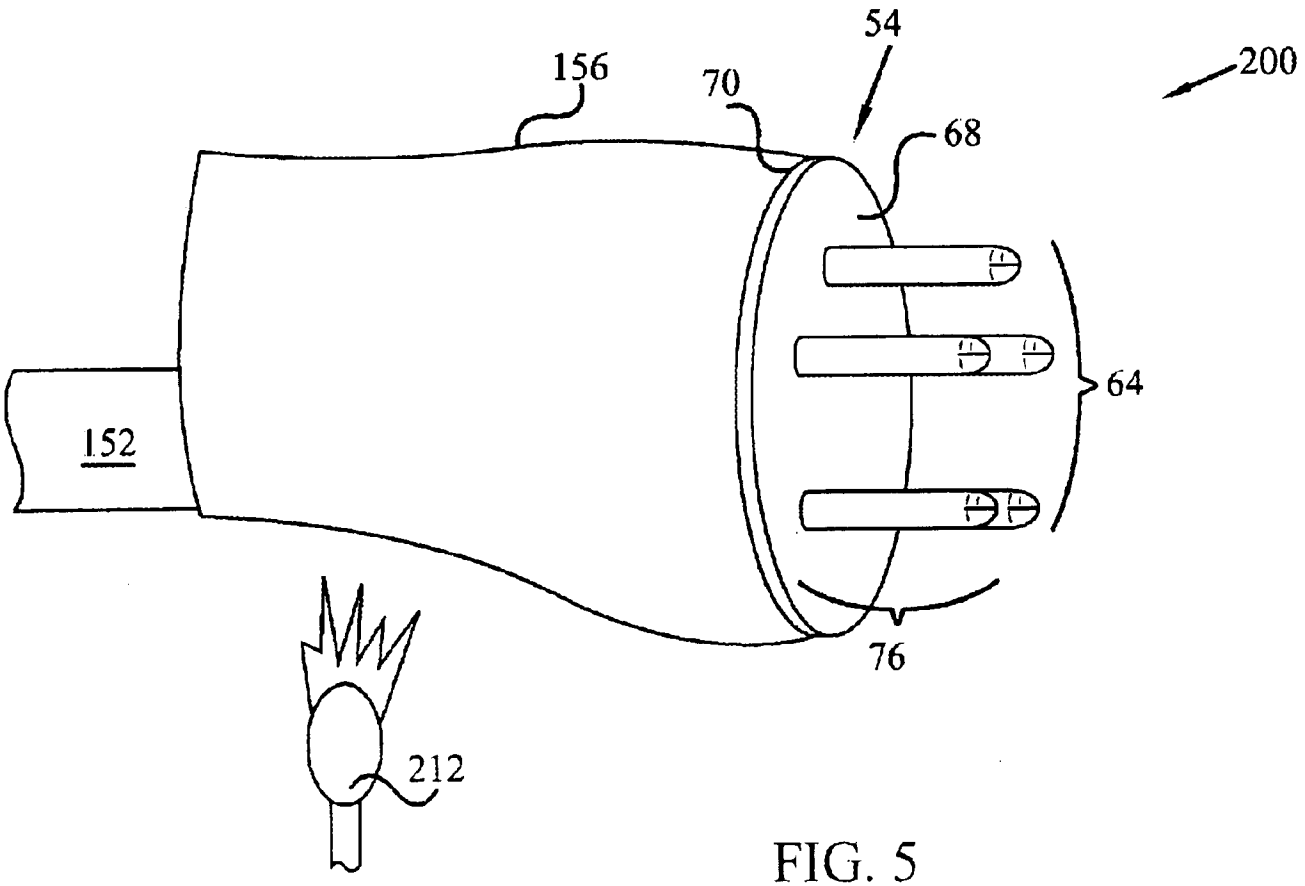
FIG. 5 is a perspective view illustrating the covering of the test connector assembly of FIG. 2.
Figure 6:
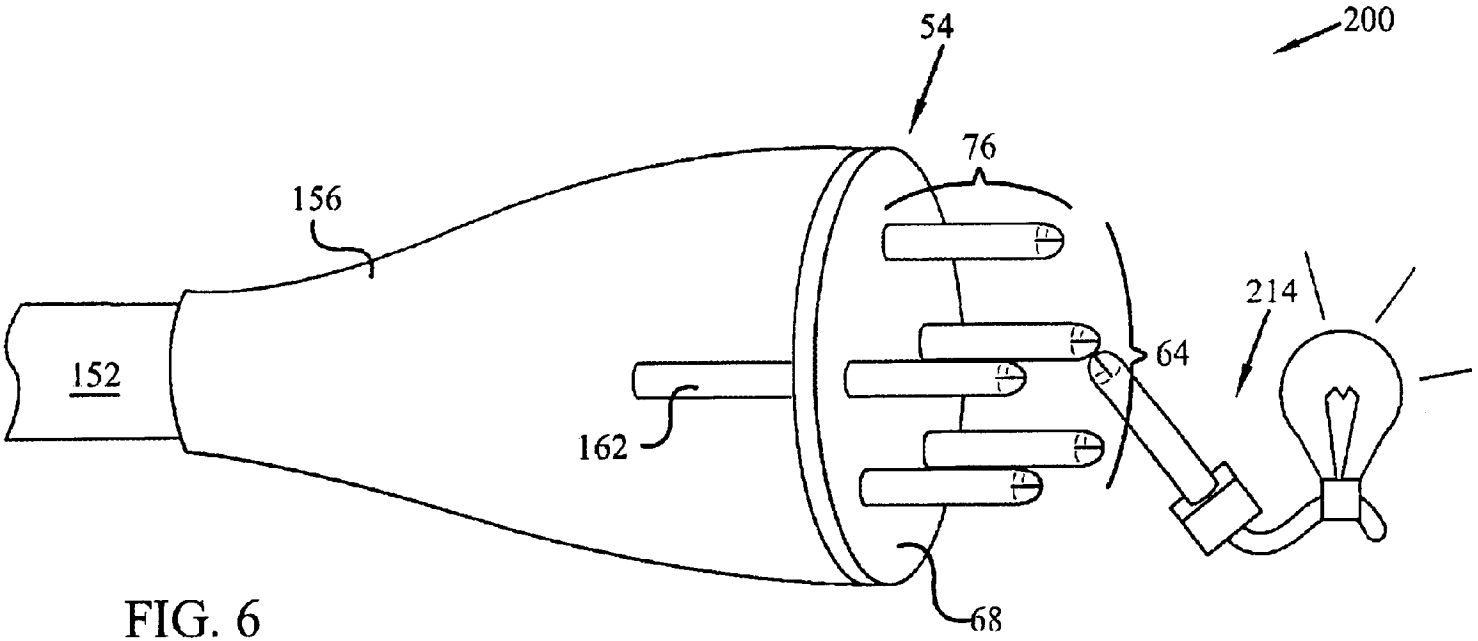
FIG. 6 is a perspective view illustrating the marking on the test connector of FIG. 2.

Having described the individual components of the test connector assembly, a preferred method of assembling a test connector 200 as shown in FIG. 6 will now be described and is illustrated in FIGS. 3 through 6. It will be appreciated that the described method need not be performed in the order in which it is herein described, but that this description is merely exemplary of one preferred method of assembling a test connector 200 in accordance with the present invention.

When a particular aircraft is available for testing, proper selection of the mating insert 54 to be used in assembling a test connector 200 is facilitated by identifying the military specification connector on the aircraft to which the test connector will be mated. Preferably, identity of the aircraft and the wiring component subsystem to be tested is sufficient to identify all of the military specification electrical connector components to be involved in the test of the wire harness and to provide wiring schematic appropriate for proper wiring of the test connector(s). Such prior identification is desired as it facilitates pre-assembly of the necessary test connector components required to properly interface with the aircraft wire harness. The type of electrical connector on the aircraft can also be identified by visual inspection.

Upon the determination of a specific military specification electrical connector on the aircraft, the technician obtains the proper kit 100 to assemble the test connector 200 that will mate with the aircraft connector. If a kit 100 is not available, the technician may instead start with obtaining the proper insert 54 for mating to the identified military specification electrical connector. The technician may obtain the correct insert 54 by cross indexing pertinent reference part numbers or by such other system as preferred by the technician. For example, military specification electrical connector No. 028088 may be determined by records to correspond to mating insert No. 020274.

Figure 1B:
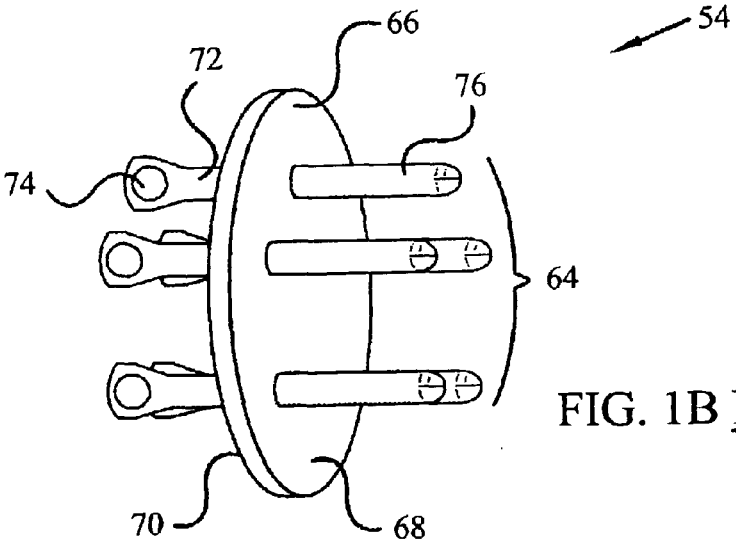
FIG. 1B PRIOR ART
FIG. 1B is a perspective view of an exemplary prior art military specification connector insert.

As shown in FIG. 1B, the insert 54 is preferably a military specification insert that would be used in the manufacture of a specific prior art military specification electrical connector (see FIG. 1A). Use of military specification inserts 54 is preferred as such inserts are generally mass produced, highly reliable, and inexpensive. Made to military specifications, the probability of an insert 54 not properly mating with its corresponding mating connector on the aircraft wire harness is extremely low, and therefore the insert 54 is desirable for the quick and reliable assembly of a test connector.

The insert 54 is preferably comprised of a non-conductive material substantially in the shape of a disc 66 through which a plurality of parallel metal contacts are mounted, perpendicular to the front 68 (first side) and back 70 (second side) surfaces of the non-conductive mounting disc 66. As shown, the metal contacts are pins 64, however it is to be appreciated that some or all of the metal contacts may be sockets (See FIG. 8). Proximate to the root 72 portion, each of the metal contact pins 64 has a wire termination location, such as an eyelet 74. Extending distally from the front 68 of the mounting disc 66, is the mating portion 76 of each contact pin 64. Under appropriate circumstances the wire termination location provided may be a sleeve, hook, post or other connection point to which a wire may be crimped, bound, soldered, or otherwise attached.

Figure 3:
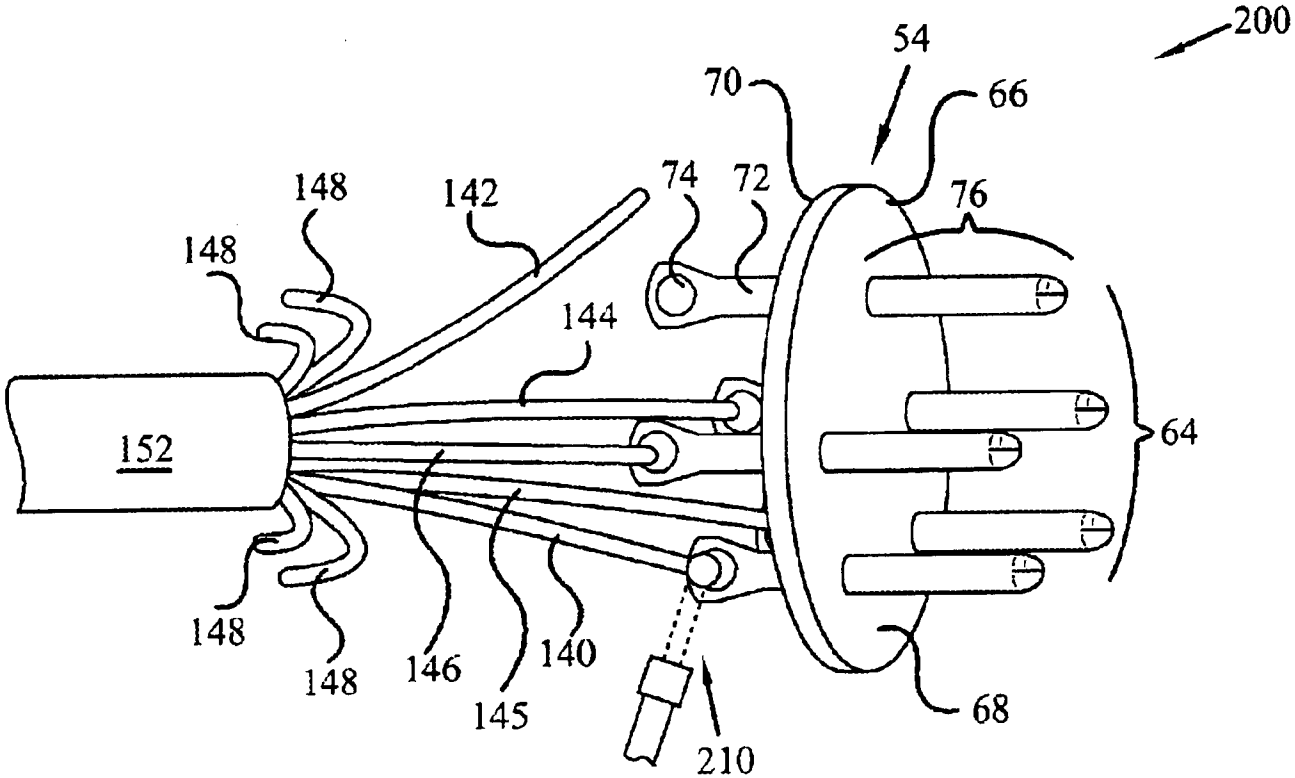
FIG. 3 is a perspective view illustrating the joining of the connector insert to the test wire harness during the construction of the assembly of FIG. 2.
Figure 4:
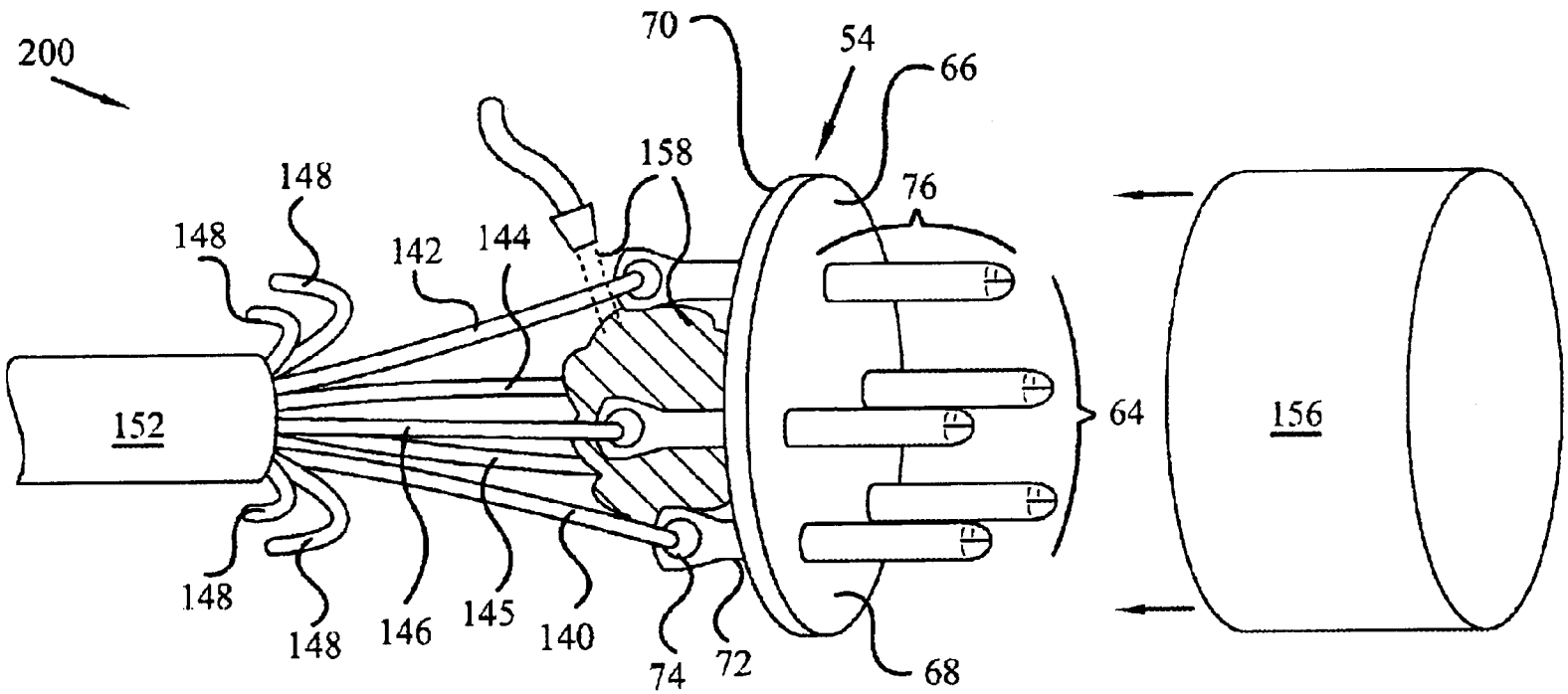
FIG. 4 is a perspective view illustrating the application of potting material during the construction of the assembly of FIG. 2.

As shown in FIG. 3, the technician attaches wires 140, 142, 144, 145 and 146 to the insert 54. Specifically, wires 140, 142, 144, 145 and 146 are joined to wire termination location 74 present at the root 72 of contact pins 64. Preferably, the technician identifies the test wires 140, 142, 144, 145 and 146 to be joined to the wire termination locations 74 of metal contact pins 64, and the order/orientation in which such joining is accomplished by using a wiring schematic or other knowledge. More specifically, it is preferred that the wiring of the test connector be substantially similar to the actual wire harness to be tested. In a preferred embodiment of the present invention, the wiring schematic is provided by the testing system for which the test connector 200 is being fabricated.

Extra wire(s) 148, if present in the test wire 152 harness, may be trimmed or folded back as shown, so as not to interfere with the attached wires. Under appropriate circumstances and as required for proper testing, it may be desirable to assemble the test connector 200 with multiple test wires connected to a specific contact pin 64. In a preferred embodiment, the joining of wires 140, 142, 144, 145 and 146 to wire termination locations 74 is accomplished by soldering 210. Under appropriate circumstances alternative joining methods such as, crimping, binding, welding, fusing, gluing, or other suitable methods may be employed.

As compared to the prior art military specification connector, the test connector does not have features that are not needed for testing, such as the clamp 21 or a hardened external backshell 9 to support and protect the wires attached to the insert. Support for the attached wires 140, 142, 144, 145 and 146 is provided by packing each joined wire of the test harness with potting material 158 (See FIG. 4). Preferably, the technician packs the joined wires with potting material comprised of a non-conductive material such as a polymer. In a preferred embodiment, the non-conductive material or polymer used as potting material is selected from the group of epoxy, silicone, rubber, acrylic, and polyurethane, although other materials could be used as required for a specific application. As shown, the potting material 158 is applied substantially proximate to the back 70 of the mounting disc 66 comprising the insert 54. More specifically, the wires 140, 142, 144, 145 and 146 of the test harness 152 incorporated into a test connector 200 are supported and sufficiently protected by the internal packing of potting material 158 rather than by the hard, robust external backshell 9 found in prior art military specification connectors.

To insulate the connections of the test wires 140, 142, 144, 145 and 146 to the metal contact pins 64, and to provide a convenient point for grasping the test connector 200, the technician covers the potting material 158 with the optional covering material 156. If the potting material 158 is sufficiently rigid or durable, no cover material may be needed. Under a preferred process of assembling the test connector 200, heat shrink tubing is the preferred covering material 156. Other non-conductive materials such as tape or resin may be used as needed for specific applications. Heat shrink tubing is a preferred covering material. As shown in FIG. 5, when a heat source 212 is applied the tubing will contract around the potting material 158. Inexpensive, readily available and self conforming to the covered components, the covering material 156 advantageously permits the technician to assemble the test connector 200 with minimal costs of time and materials.

As shown, the covering material 156 is applied substantially proximate to the back 70 of insert 54. More specifically, it is preferred that the covering material 156 not extend beyond the front 68 of mounting disc 66, as such excess covering material 156 may interfere with the mating portion 76 of contact pins 64 during connection of the test connector 200 to the connector on the aircraft wire harness. As shown in FIG. 6, under appropriate circumstances, the assembled test wire harness 152 and test connector 200 may then be tested, preferably with circuit continuity tester 214.

As noted above, generally a military specification electrical connector is configured to permit a mating connection in a specifically aligned orientation. To ensure proper mating of the assembled test connector 200 with the aircraft harness military connector, the technician creates an alignment indicator 162 on the test connector 200 to key the alignment of the test connector 200 to the aircraft connector. Preferably, the alignment indicator is a visual indicator or marking placed on covering 156. In a preferred embodiment, marking with a material such as ink, pen or tape is performed to achieve alignment indicator 162. Preferably, marking 162 is proximate to a specific contact pin 76 that is identified as the key contact pin 78 (See FIG. 6).

As the test connector 200 does not have a costly backshell 9, shield 15, coupling 19, and other specialized components common to conventional military specification electrical connectors 7 (see FIG. 1A), the value of the test connector 200 is minimal and it may therefore be discarded following the completion of the test procedure. The test connector 200 may also be reused a limited number of times for subsequent tests.

With respect to the kit 100 shown in FIG. 2, it should be appreciated that the kit 100 could include all necessary inserts 54, covering 156, potting material 158, and marking material 160 sufficient to assemble all of the necessary test connectors for testing a specific aircraft wire harness.

Figure 7:
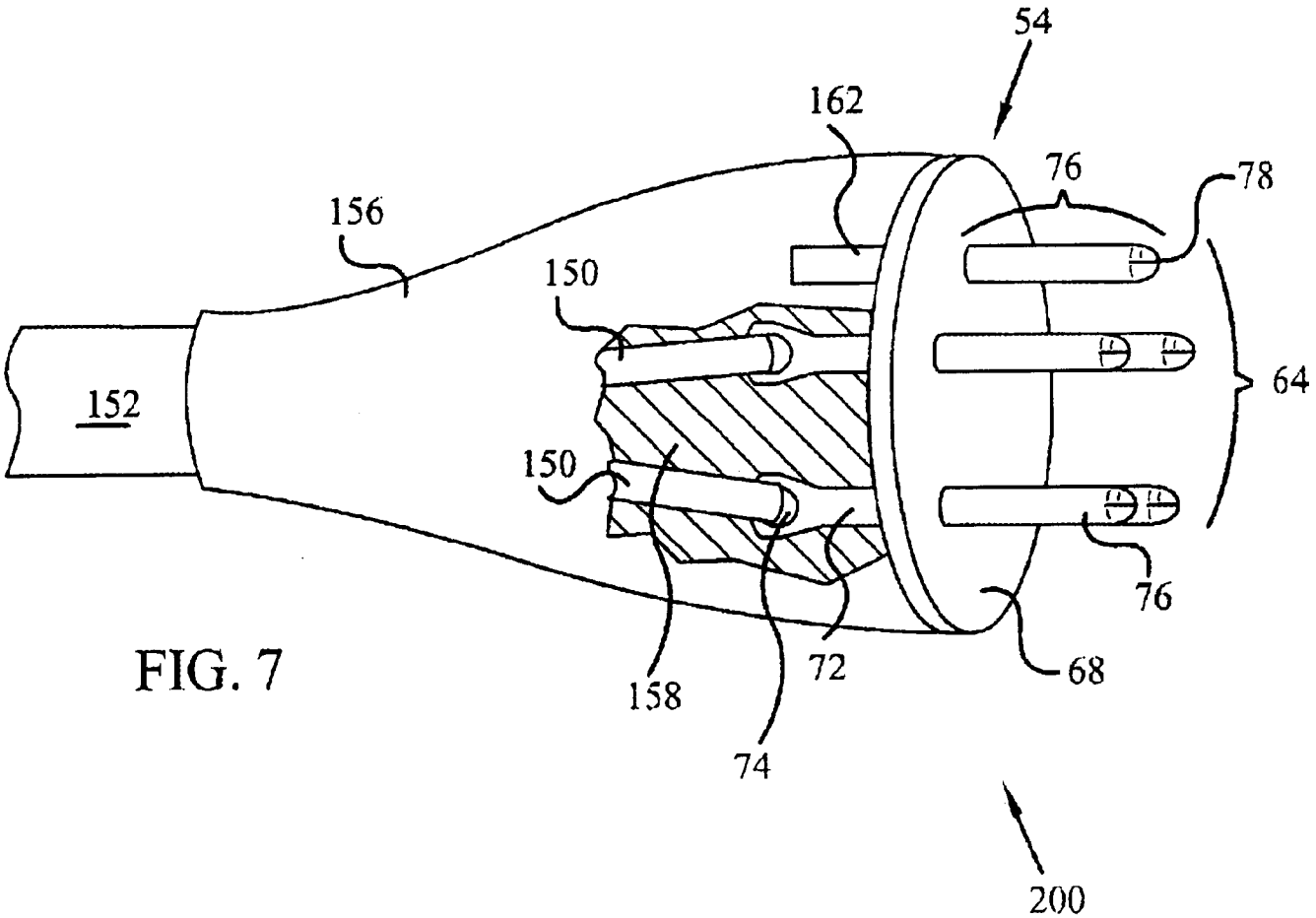
FIG. 7 is a perspective, partial cut away view of a test connector assembly according to an embodiment of the present invention.

The method of assembling a test connector, results in a preferred test connector 200 attached to test wire harness 152, as is illustrated in the perspective partial cut away view of FIG. 7. For testing purposes, the wire harness 152 presenting connector 200 is coupled to any type of wire test device (not shown).

Figure 8:
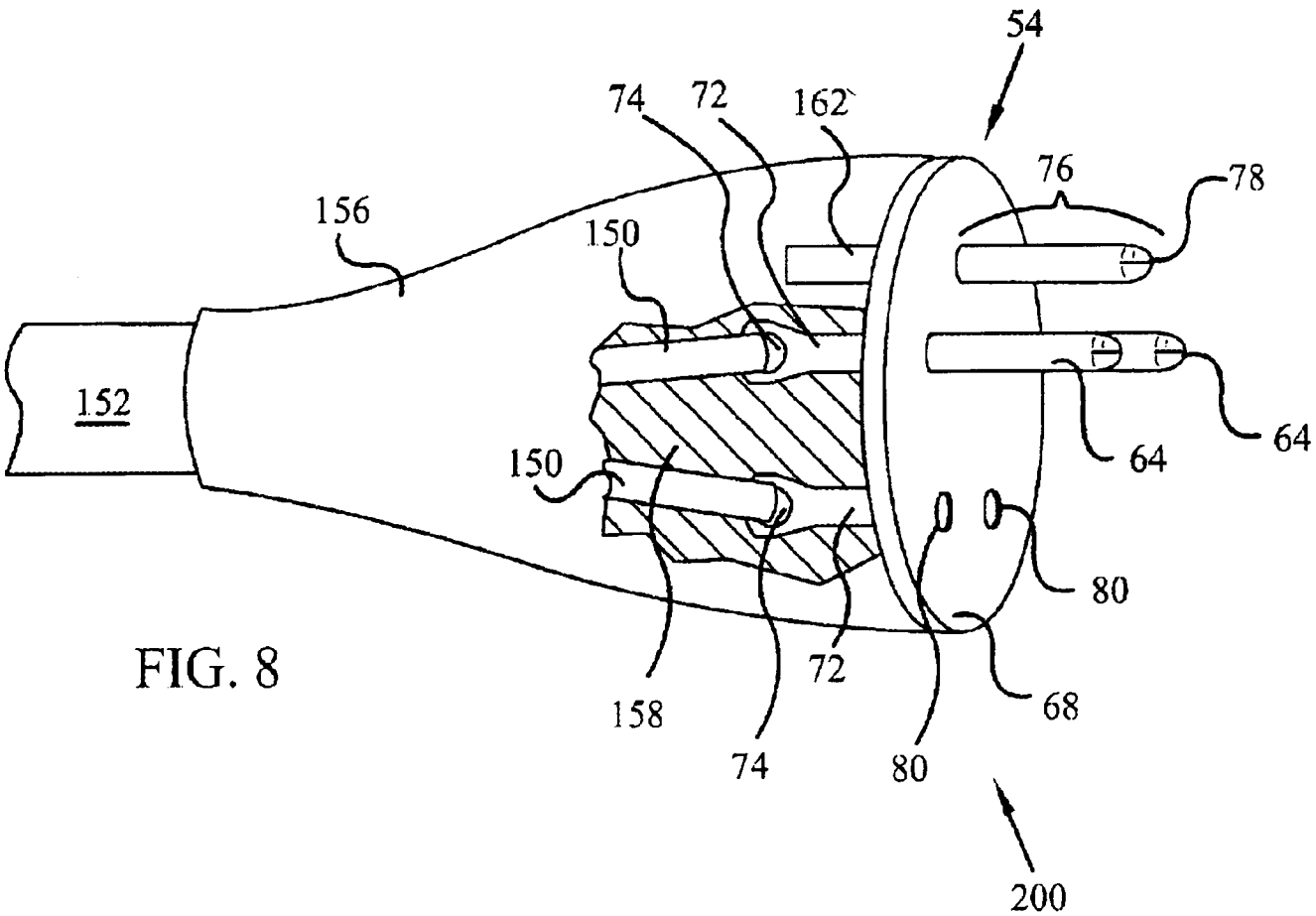
FIG. 8 is a perspective, partial cut away view of a test connector assembly according to an embodiment of the present invention providing pin and socket connections.

The test connector 200 is comprised of an insert 54, optional covering 156, potting material 158 serving to support the joined wires 150 constituting the wire harness 152, and an optional alignment indicator 162. The test connector 200 is manually assembled and configured to mate or join with an aircraft wire harness having a military specification or other electrical connector. As noted above, insert 54 may comprise connectors incorporating pins, sockets, combinations of both, or other types of connections. FIG. 8 shows a test connector 200 with insert 54 providing sockets 80 in addition to pins 68.

The test connector 200 can advantageously be assembled on the site where the aircraft testing will take place. The test connector 200 does not have the bulky metal backshell 9, metal shield 15, or threaded coupling 19 of the prior art military specification connector 7 (see FIG. 1A). The test connector 200 is therefore less costly to produce and may be connected by a technician with greater ease and time efficiency.

While the invention has been described with reference to the preferred embodiments, it will be understood by those skilled in the art that various changes may be made and equivalents may be substituted for the elements thereof and steps thereof without departing from the scope of the present invention. In addition, many modifications may be made to adapt to a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

I claim:

1. A method of assembling a test connector to attach a test wire harness comprising at least one wire to a connector of an aircraft wire harness, the method comprising:

joining the at least one wire of the test wire harness to an insert having a plurality of electrical contacts configured to mate with the aircraft wire harness connector;

packing each joined wire of the test harness with non-conductive potting material where each joined wire is joined to the insert; and directly covering the non-conductive potting material with non-conductive, heat shrink tubing material, while maintaining the electrical contacts substantially exposed and not covered by the heat shrink tubing.

2. The method of claim 1, further comprising forming an alignment indicator on the test connector.

3. The method of claim 2, wherein the alignment indicator is formed by creating a mark on the test connector.

4. The method of claim 1, wherein the insert is substantially circular in cross section.

5. The method of claim 1, wherein the aircraft wire harness connector is a military specification electrical connector and insert is a military specification connector insert configured to mate to the military specification electrical connector.

6. The method of claim 1, further comprising testing the connectivity of the test wires after they are joined to the insert.

7. The method of claim 1, wherein the at least one wire of the test wire harness is joined to the insert by soldering.

8. The method of claim 1, wherein the non-conductive potting material is selected from a group consisting of epoxy, silicone, rubber, acrylic, or polyurethane.

9. The method of claim 1, wherein the insert has electrical sockets.

10. The method of claim 1, wherein the insert has electrical pins.

11. The method of claim 1, wherein the insert has a combination of at least one electrical socket and at least one electrical pin.

12. A method of manually assembling a test connector to attach a test wire harness having at least one wire to a connector of an aircraft wire harness, the aircraft wire harness connector having an alignment key, the method comprising:

joining the at least one wire of the test wire harness to an insert having a plurality of electrical contacts configured to mate with the aircraft wire harness connector;

packing each joined wire of the test wire harness with non-conductive potting material where each joined wire is joined to the insert;

directly covering the non-conductive potting material and joined wires with non-conductive, heat shrink tubing material while maintaining the electrical contacts substantially exposed and not covered by the heat shrink tubing material; and forming an alignment indicator on the heat shrink tubing.

13. The method of claim 12, wherein the aircraft wire harness connector is a military specification electrical connector and insert is a military specification connector insert configured to mate to the military specification electrical connector.

14. A test connector assembly for use in connecting a test wire harness having test wires to a connector of an aircraft wire harness, the test connector assembly comprising:

a mating insert configured to mate with the aircraft wire harness connector, the insert having a first side, an opposed second side, and a plurality of electrical contacts, each contact having one end configured to mate with an aircraft connector and another end joined to a test wire from the test wire harness;

a non-conductive potting material manually inserted between the joined test wires proximate to the insert; and non-conductive, heat shrink tubing installed directly around the potting material and joined test wires, wherein the plurality of electrical contacts are substantially exposed and not covered by the heat shrink tubing.

15. The test connector assembly of claim 14, further comprising an alignment indicator mark formed on the heat shrink tubing.

16. The test connector assembly of claim 14, wherein the test connector insert is substantially circular in cross section.

17. The test connector assembly of claim 14, wherein the aircraft wire harness connector is a military specification electrical connector and insert is a military specification connector insert configured to mate to the military specification electrical connector.

18. The test connector assembly of claim 14, wherein the non-conductive potting material is selected from a group consisting of epoxy, silicone, rubber, acrylic, or polyurethane.

19. The test connector assembly of claim 14, wherein the insert has electrical sockets.

20. The test connector assembly of claim 14, wherein the insert has electrical pins.

21. The test connector assembly of claim 14, wherein the insert has a combination of at least one electrical socket and at least one electrical pin.

22. A kit for assembling at least one test connector for use in connecting a test wire harness comprising at least one wire to at least one predetermined connector of an aircraft wire harness, the kit comprising:

at least one conductive mating connector insert having a plurality of electrical contact configured to mate with the predetermined aircraft wire harness connector;

non-conductive potting material to support the at least one wire of the test wire harness wires when joined to the insert; and non-conductive heat shrink tubing to directly cover the potting material and joined test wires, while maintaining the electrical contacts substantially exposed and covered by the heat shrink tubing.

23. The kit of claim 22, wherein the aircraft wire harness connector is a military specification electrical connector and each insert is a military specification connector insert configured to mate to the military specification electrical connector.

24. The kit of claim 23, further comprising solder for connecting the test wire harness to the military specification connector insert.

25. The kit of claim 22, further comprising marker material to identify key mating alignment of the test connector to the aircraft connector.

26. The kit of claim 22, wherein such non-conductive potting material is selected from a group consisting of epoxy, silicone, rubber, acrylic, or polyurethane.

27. The kit of claim 22, wherein the at least one insert has electrical sockets.

28. The kit of claim 22, wherein the at least one insert has electrical pins.

29. The kit of claim 22, wherein the at least one insert has a combination of at least one electrical socket and at least one electrical pin.

* * * * *